United States Patent [19]

Hockensmith

[11] 4,151,786

[45] May 1, 1979

[54] OUTRIGGER BEAM AND JACK CONSTRUCTION

[75] Inventor: John L. Hockensmith, Chambersburg, Pa.

[73] Assignee: JLG Industries, Inc., McConnellsburg, Pa.

[21] Appl. No.: 796,380

[22] Filed: May 12, 1977

[51] Int. Cl.[2] ..... F01B 15/02; F01B 29/00

[52] U.S. Cl. ..... 92/117 R; 92/161; 280/766

[58] Field of Search ..... 92/161, 161.5, 117 A, 92/117 R; 280/766, 763

[56] References Cited

U.S. PATENT DOCUMENTS

| | | | |
|---|---|---|---|
| B. 583,051 | 2/1976 | Hornagold | 280/766 |
| 3,454,114 | 7/1969 | Poage | 92/117 R |

FOREIGN PATENT DOCUMENTS

| | | | |
|---|---|---|---|
| 464565 | 4/1950 | Canada | 280/766 |

*Primary Examiner*—Paul E. Maslousky
*Attorney, Agent, or Firm*—Irvin A. Lavine

[57] ABSTRACT

An extensible outrigger construction comprises a tubular housing secured to a vehicle frame, having an outrigger beam telescoped into it. The outrigger beam comprises upper and lower horizontal plates with semi-circular cut-outs at their ends to receive the cylinder of the jack; a pair of vertical flange plates have surfaces on a diametral plane of the cut-out. A cap includes upper and lower horizontal plates with semi-circular cut-outs, and vertical flange plates engaging the first mentioned flange plates, the holding cap being secured by bolts through the flange plates. The jack cylinder has an upwardly facing shoulder that engages the bottom surfaces of the lower beam plate and the lower plate of the holding cap. The cylinder of the jack has a chamfer which seats in a corresponding chamfer of the top plates.

10 Claims, 6 Drawing Figures

15
4
5
5
31
23
53
51
31
31a
51a
40
48
41
36
46
48
48
38a
58a
38
58
24a
33
24
25
32
29
4
61
62
63
64

OUTRIGGER BEAM AND JACK CONSTRUCTION

The present invention relates to the construction of an outrigger to be used with machines such as cranes and the like, in order to provide additional stability.

Cranes are one type of vehicles which perform specialized work at a fixed location. As they are subject to overturning forces, in order to increase their ability, there have been provided in the prior art stability increasing devices, known as outriggers. Generally, outriggers have a retracted position in which they are non-functioning, and an extended position, in which a foot or pad of the outrigger engages the ground, so that overturning forces pass from the vehicle into the outrigger, and thence through the foot or pad, into the ground.

In providing outriggers, there have been utilized tubular housings which extend transversely of the vehicle, with extendable outrigger beams telescopically positioned in the tubular housing. In a number of instances, hydraulic cylinders have been utilized to extend and retract the outrigger beams. At their ends, the outrigger beams have been provided with a hydraulic jack, having an extensible piston rod, on the end of which was a pad or foot for engaging the ground. In known constructions, to connect the hydraulic cylinder to the extensible beam, the beam was provided on its end with a generally rectangular box-like construction, having a vertical axis, with the hydraulic jack carried in this box-like structure. This construction added a substantial width to the outrigger assembly in retracted position, so that in order to accommodate the noted construction, the housing was made somewhat shorter. This resulted in a greater extension than desired of the outrigger beam out of the supporting housing when the outrigger beam was in the extended position. Otherwise stated, with the noted construction, there was either a greater width of the outrigger assembly in retracted position than was desired, or there was a greater length of the outrigger beam outwardly of the housing when the outrigger beam was extended.

A known construction for avoiding the provision of a box-like construction on the outer end of the extensible beam is disclosed in Keller, Jr., U.S. Pat. No. 3,677,417. In this construction, the upper and lower plates of the outrigger beam had arcuate edges to receive the hydraulic jack, and also had outwardly extending horizontal flanges. The hydraulic jack had a flanged collar welded to its outer surface, near the bottom. This collar was provided with bolt holes which matched with bolt holes in the bottom plate and the flanges of the bottom plate to secure the hydraulic jack to the outrigger beam. In addition, a C-plate was provided which partially encircled the hydraulic jack, and was in facing engagement with the flanges of the upper plate of the outrigger beam, with bolts connecting the C-plate to the flanges of the outrigger beam upper plate. This construction resulted in a substantial stress concentration at the connection between the flanges of the bottom plate and the flanged collar, as well as requiring the welding of the flanged collar to the cylinder. This connection resulted in the transmitting of both vertical loads and moments between the two plates, with the C-shaped plate being used to also resist any moments tending, for example, to rotate the hydraulic jack outwardly and away from the outrigger beam. The assemblage of the above noted construction required that the flanged collar be first bolted to the bottom plate and the flanges thereof, and then the C-shaped plate placed in position and holes drilled in it, for the insertion of the bolts to secure the C-shaped plate to the flange of the beam upper plate. This was an expensive operation, and where it was required to replace the hydraulic jack in the field, it was necessary to provide a new C-shaped plate, and to drill it in the field. In addition, the noted construction required a circular jig for drilling the bolt holes of the flanged collar and the bottom plate.

There has also been provided in the prior art, as shown in Mulholland et al U.S. Pat. No. 3,033,523, a construction for connecting a hydraulic levelling jack to a supporting structure, somewhat in the nature of an outrigger. This construction included a jack clamping bracket made of an inner part with a semi-circular opening connected to the vehicle frame structure, and an outer part, also having a semi-circular opening, with bolts passing transversely through the parts to assemble them together and to clamp the jack between them. This construction relied upon a sufficient clamping force of the clamping bracket to resist vertical movement of the jack cylinder under load, and such clamping forces would tend to distort the cylinder, with danger that the cylinder of the jack would be distorted so as to interfere with the movement of the piston therewithin. In addition, this construction required the addition of the bracket at the end of the supporting structure, thereby adding width, as set forth in connection with the first mentioned known construction.

The herein disclosed outrigger beam and jack construction comprises a connection between the beam and the hydraulic jack which includes semi-circular cutouts in a pair of vertically spaced, horizontal plates of the outrigger beam, and a retention cap having upper and lower plates which are horizontal and which are generally coplanar with the plates of the outrigger beam. In order to transfer the loads between the beam and the jack, the bottom surfaces of the lower plates provide a downwardly facing shoulder which directly engages an upwardly facing shoulder forming a part of the end cap of the hydraulic cylinder. The upper and lower plates of the retention cap engage the hydraulic cylinder at spaced locations, and thereby resist moments tending to rotate the hydraulic jack about a horizontal axis, and outwardly of the extension beam. Thus, the herein provided construction enables the bottom plates and cylinder end cap shoulders to transfer both vertical loads and moments. The retention cap and the outrigger beam have mating, engaging vertical plates, detachably secured by horizontal bolts, this construction further providing for transfer of loads from the jack into the outrigger beam without imposing bending moments on the outrigger beam at the connection location. In addition, in order to support the weight of the hydraulic cylinder when the piston is retracted and therefore there is no engagement with the ground, the cylinder is provided with a conical, downwardly facing shoulder intermediate its length, which seats in an upwardly facing conical seat provided in the upper plates of the outrigger beam and retention cap.

The construction herein provided has as objects the provision of a connection between an outrigger beam and a hydraulic jack which will provide for stress distribution of loads at the connection of the jack to the beam, will provide for improved load transfer into the outrigger beam, permits ready replacement of the hydraulic jack, without replacing additional parts, and also provides a construction in which minimum retracted width is achieved, with relatively great support of the outrigger beam in the extended position thereof. Further, the herein disclosed construction may be readily constructed, without special jigs or the like.

Figure 1:
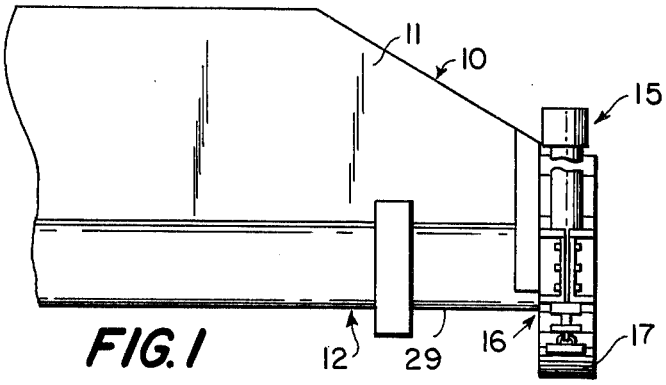
FIG. 1 is a rear elevational view of a part of a vehicle, with an outrigger in accordance with the present invention.
Figure 3:
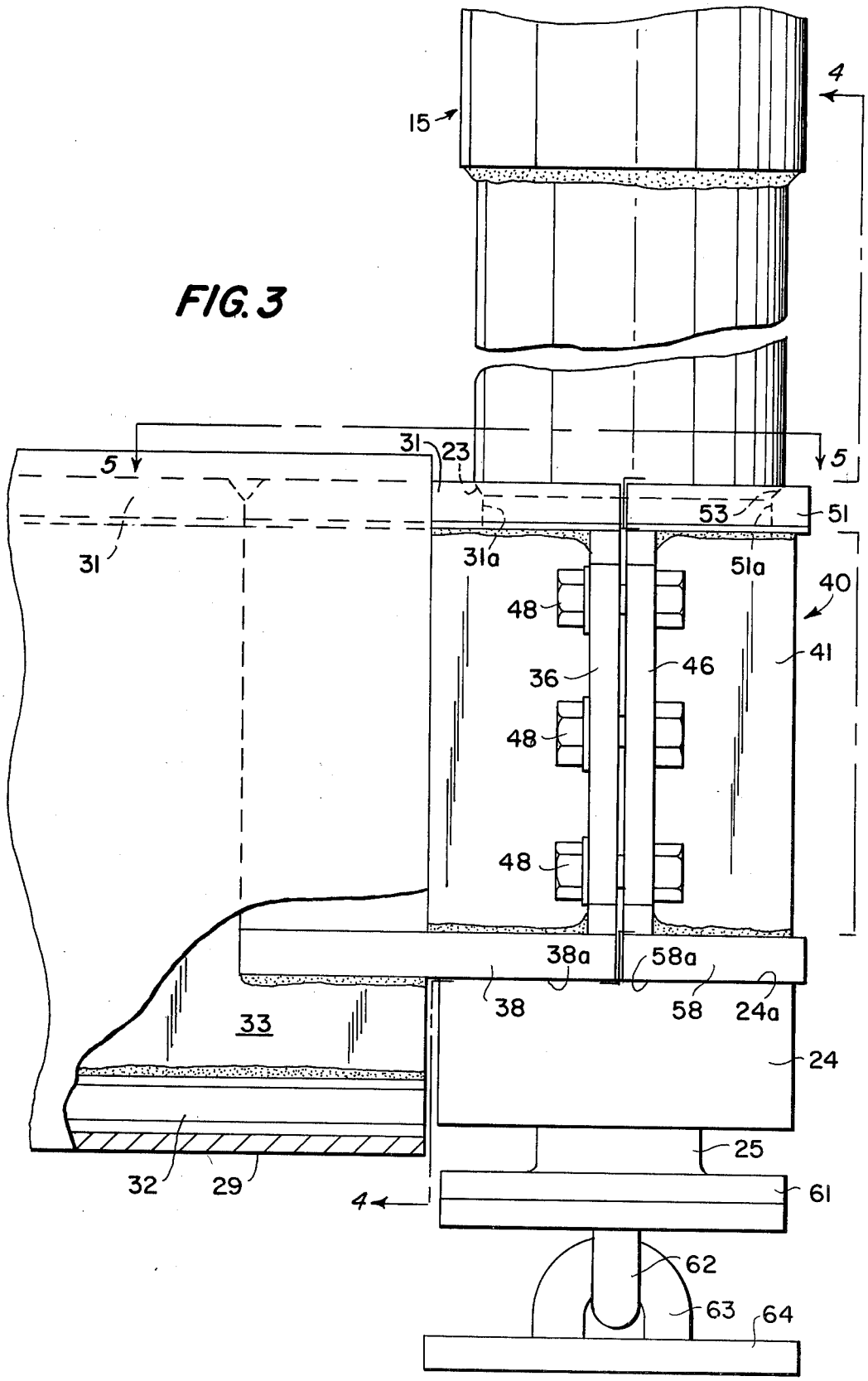
FIG. 3 is an enlarged view of the outrigger beam and jack portion of FIG. 1.
Figure 4:
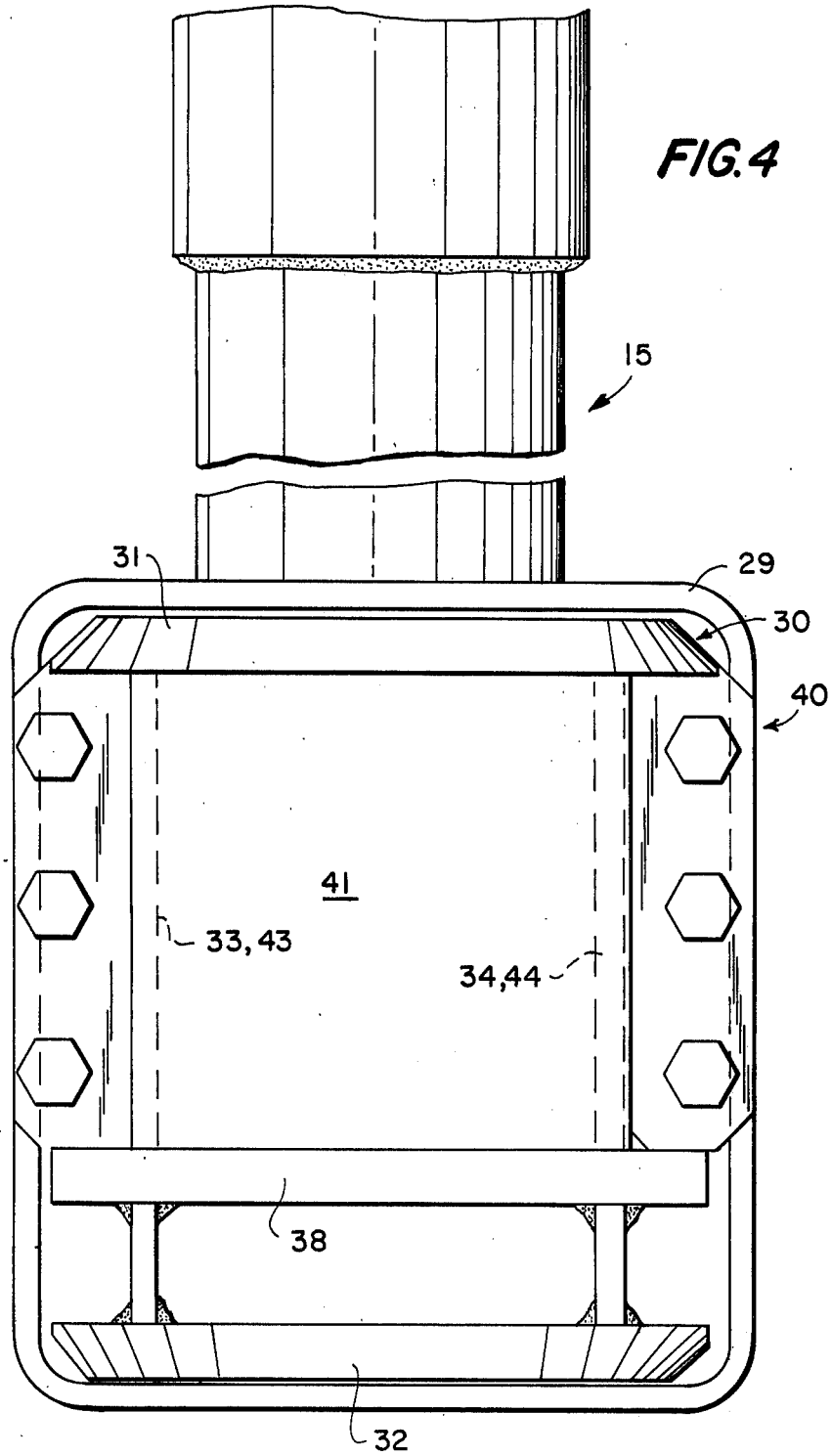
FIG. 4 is a view taken on the line 4—4 of FIG. 3.

Referring now to the drawings, wherein like or corresponding reference numerals are used to designate like or corresponding parts throughout the several views, there is shown in FIG. 1 a vehicle 10 having a frame portion 11 to which is connected an outrigger generally designated 12. Outrigger 12 includes the jack 15, and the connection 16 for connecting the jack 15 to the outrigger beam 30 (FIGS. 3 and 4). It will be noted that the greatest width of the vehicle when the outrigger beam is in the fully retracted position as shown in FIG. 1 is defined by a plane at the outer margin of the tire 17, beyond which plane the outrigger beam, jack assembly and connecting structure do not extend.

Figure 2A:
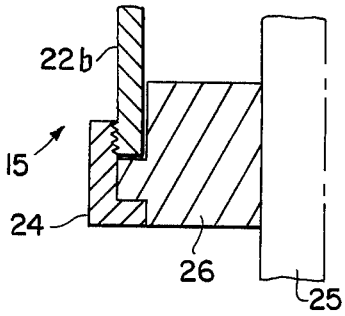
FIG. 2A is a cross sectional view taken on the line 2A—2A of FIG. 2.
Figure 2:
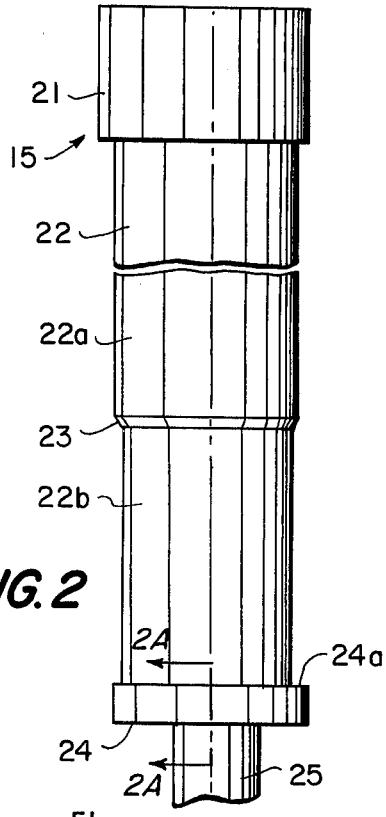
FIG. 2 is an elevational view, with parts broken away, of a hydraulic jack in accordance with the present invention.

In FIG. 2 there is shown, in elevation, and with parts broken away, the hydraulic jack 15 in accordance with the present invention, which is provided with an upper end cap 21, a cylinder 22, the cylinder 22 having a relatively large outer diameter upper end 22*a* and a somewhat smaller outer diameter lower end 22*b*. A downwardly facing conical surface 23 is provided between the two portions of the cylinder 22. At its lower end, the cylinder 22 of the jack 15 is provided with an end cap 24 having an upwardly facing shoulder 24*a*. A piston rod 25 extends from end cap 24.

Referring to FIG. 2A, there may be seen the cylinder 22 of the hydraulic jack 15, the lower end of which is screw threaded, and having screwed to it the end cap 24. A guide bushing 26 is clamped by the end cap 24 against the lower end of the cylinder 22, and serves to guide piston rod 25 therein. Seals and the like which are normally a part of such bushings have been omitted, for clarity.

In FIGS. 3 and 4, there may be seen the tubular housing 29 in which the outrigger beam 30 is telescopically positioned. Outrigger beam 30 includes an upper plate 31, a lower plate 32, and vertical plates 33 and 34 extending between and welded to them, to thereby provide a conventional box beam outrigger.

Figure 5:
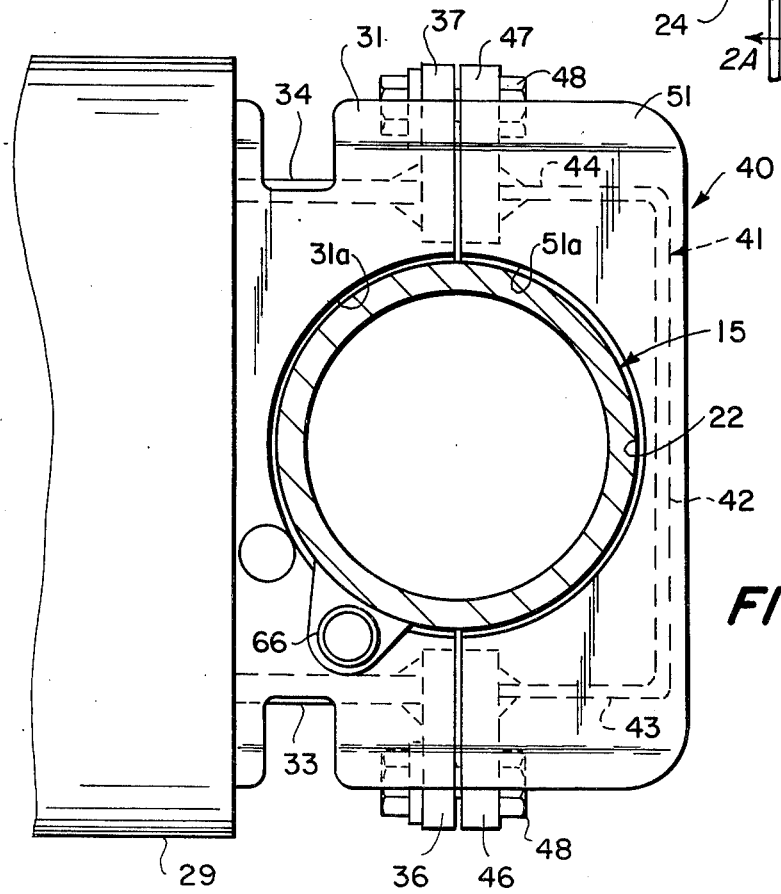
FIG. 5 is a cross sectional view taken on the line 5—5 of FIG. 3.

As shown in FIG. 5, the top plate 31 has a semi-circular cut-out 31*a*, and as may be seen in FIG. 3, there is a vertically extending plate 36 welded to the bottom of the top plate 31 of outrigger beam 30. A similar plate 37 is also shown in FIG. 5, plates 36 and 37 thereby providing a substantially vertically extending planar surface. As shown in FIG. 3, a lower or bottom plate 38 is welded to the vertical plate 36, and also to the vertical plate 37, at the bottom thereof. This bottom plate 38 may also be seen in FIG. 4, being above the bottom plate 32 of the outrigger beam 30. The bottom plate 38 extends rearwardly from the plate 36 a short distance, being welded, as shown, to the side plate 33 of the outrigger beam 30.

In order to assist in carrying upwardly directed forces from the hydraulic jack 15 into the outrigger beam 30, and to react against moments acting on the hydraulic jack, and to distribute horizontal components of such moments evenly into the outrigger beam 30, there is provided a retention cap 40 which is detachably secured to the outrigger beam 30 and which partially encircles the hydraulic jack 15. The retention cap 40 forms a part of the connection between the hydraulic jack 15 and the outrigger beam 30, along with the aforementioned plates 31 and 38, and vertical plates 36 and 37.

The cap 40 will be seen in FIG. 3 to extend axially along the hydraulic jack 15. It comprises (see FIG. 5) a channel 41 which is vertically extending, having a web 42 and a pair of legs 43 and 44. A vertical plate 46 is welded to the end of the leg 43 and a corresponding vertical plate 47 is welded to the end of the leg 44 of the channel 41. The plates 46 and 47 are in facing relationship with the plates 36 and 37, respectively, and bolts 48 extend through these plates 36, 46, and 37, 47, to thereby secure the retainer cap 40 to the outrigger beam 30.

The retainer cap 40 also includes an upper plate 51 which is substantially coplanar with the upper plate 31, being attached at the upper end of the channel 41, there also being provided a lower plate 58 which is substantially coplanar with the plate 38.

More particularly, the facing plates 38 and 58 together provide a shoulder, formed by their lower or bottom surfaces 38*a* and 58*a*. These surfaces are engaged by the upwardly facing shoulder 24*a* of the end cap 24 of the hydraulic cylinder 15. Thus, vertical forces acting upwardly on the hydraulic jack 15 are distributed into the plates 38 and 58 by the engagement of these downwardly facing and upwardly facing shoulders, and those forces are distributed widely into the outrigger beam 30, without imparting bending moments into the outrigger beam 30 where the connecting structure is joined to it.

The upper plate 51 of the retention cap 40, as shown in FIG. 5, has a generally semi-circular cut-out 51*a*, which, together with the cut-out 31*a* in the upper plate 31 provides a generally cylindrical opening through the plates 31 and 51 to accommodate the cylinder 22 of hydraulic jack 15. As will be understood, the lower plates 38 and 58 have similar cut-outs (not shown). In addition, there is provided as shown in FIG. 3 an upwardly facing conical seat 53, which is formed in the plates 31 and 51, which upwardly facing conical seat 53 receives the downwardly facing conical shoulder 23 of the cylinder 22. Thus, when the piston and piston rod 25 of the hydraulic jack 15 are in the raised position, as during transport, the shoulder 23, cooperating with seat 53, will provide for the sustaining of the weight of the hydraulic jack 15. In this connection, while the hydraulic jack is engaged by the plates 31 and 51, and by the plates 38 and 58, at axially spaced locations along the cylinder 22, there is not relied upon a strong clamping action which might distort the cylinder 22, but instead there is sufficient engagement of these elements so as to insure against play of the cylinder 22, that is, motion of the cylinder transversely of its longitudinal axis.

In conventional manner, the hydraulic jack 15 has piston rod 25 thereof provided at its lower end with plates 61, to which a U-bolt 62 is connected, having a second U-bolt 63 swivelly connected to it, the U-bolt 63 supporting a ground engaging foot or pad 64. Also, as is conventional, as shown in FIG. 5 there is provided adjacent the cylinder 22 a conduit 66 for hydraulic fluid, and there is an appropriate cut-out in the plate 31 for that conduit.

There has been provided an outrigger beam and jack construction providing for improved stress distribution from the hydraulic jack into the outrigger beam, with the provision of a single element, the retention cap, for absorbing both vertical loads and moments, thereby providing for improved load transfer into the outrigger beam. The present construction enables the ready replacement of a hydraulic jack in the field, by the mere disassembly and reassembly of the retention cap, without requiring the shipment therewith of any special fixtures, or the drilling of holes in the field. Further, the present construction avoids the necessity for welding plates or the like to the hydraulic jack, requires no special jigs as are required for holes placed in a circle, and avoids a construction in which a significant clamping force is required in order to assemble the hydraulic jack to the outrigger beam. Further, the herein disclosed construction enables the outrigger assembly to have a minimum width in the retracted position thereof, while, in addition, providing maximum telescopic engagement between the outrigger beam and its housing in the extended position of the outrigger beam.

It will be obvious to those skilled in the art that various changes may be made without departing from the spirit of the invention, and therefore the invention is not limited to what is shown in the drawings and described in the specification but only as indicated by the appended claims.

I claim:

1. An outrigger beam and hydraulic jack construction comprising:

a supporting housing, an outrigger beam telescopically movable in said supporting housing, comprising substantially horizontal upper and lower plates having outer ends outwardly of the housing, means at the outer end of the beam for connecting the hydraulic jack thereto comprising:

a semi-circular cut-out in the outer ends of said outrigger beam upper and lower plates for receiving a semi-circular portion of the jack in vertical position, and a retention element detachably secured to said outrigger beam and comprising:

substantially horizontal upper and lower plates partially encircling said jack, means connecting said retention element upper and lower plates in assembled relationship, said lower plates being coplanar and each having a downwardly facing shoulder at the bottom thereof, said jack comprising a cylinder, piston and piston rod, said cylinder at the lower end thereof having a cap with an upwardly facing shoulder engaging said shoulders of said lower plates, said connecting means engaging said hydraulic jack only at the spaced locations of said upper and lower plates.

2. The outrigger beam and jack construction of claim 1, wherein said cap and said outrigger beam have vertically extending flange plates, and transverse bolt means securing said flange plates in facing engagement.

3. The outrigger beam and jack construction of claim 1, said retention element connecting means comprising a vertical channel having legs, a vertical plate at the end of each leg of the channel, said retention element horizontal plates being at each end of the channel.

4. The outrigger beam and jack construction of claim 3, said cylinder having a downwardly facing shoulder intermediate the ends thereof, said upper horizontal plates having a surface engaging said downwardly facing shoulder.

5. The outrigger beam and jack construction of claim 4, said downwardly facing shoulder and said engaging surface of said upper horizontal plates being conical.

6. The outrigger beam and jack construction of claim 1, wherein said connecting means and said jack have interengaging seating means for supporting said jack on said outrigger beam.

7. The outrigger beam and jack construction of claim 6, wherein said jack has a downwardly facing shoulder intermediate the ends thereof, and said connecting means comprises a seat for said downwardly facing shoulder.

8. The outrigger beam and jack construction of claim 1, said retention element and said outrigger beam having vertically extending plates in facing engagement, and means detachably securing said vertically extending plates in said facing engagement.

9. An outrigger beam and jack construction comprising;

a supporting housing, an outrigger beam telescopically movable in the supporting housing comprising substantially horizontal upper and lower plates having their outer ends outwardly of the housing, a semi-circular cut-out in each of the outer ends of said outrigger beam upper and lower plates for receiving a semi-circular portion of the jack in vertical position, a retention element detachably secured to said outrigger beam and comprising upper and lower plates respectively coplanar with the outrigger beam upper and lower plates and having semi-circular cut-outs therein in facing relationship to the cut-outs of said outrigger beam plates, said retention element further comprising means connecting the upper and lower plates, said upper plates having an upwardly facing seat and said lower plates having a downwardly facing shoulder, said outrigger beam and retention element engaging said jack only with said upper and lower plates thereof.

10. The outrigger beam and jack construction of claim 9, said upwardly facing seat being conical.

* * * * *